US006526635B2

(12) United States Patent
Nasu et al.

(10) Patent No.: US 6,526,635 B2
(45) Date of Patent: Mar. 4, 2003

(54) CORD CLIP

(75) Inventors: Koji Nasu, Yao (JP); Satoru Fujiwara, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 09/919,914

(22) Filed: Aug. 2, 2001

(65) Prior Publication Data

US 2002/0020045 A1 Feb. 21, 2002

(30) Foreign Application Priority Data

Aug. 10, 2000 (JP) ..... 2000-242444

(51) Int. Cl.[7] ..... A44B 17/00; B65D 63/00; F16B 7/04

(52) U.S. Cl. ..... 24/543; 24/17 B; 24/346; 24/545; 24/546; 24/563

(58) Field of Search ..... 24/546, 17 B, 24/30.5 P, 30.5 R, 543, 545, 563, 122.6, 130; 251/10

(56) References Cited

U.S. PATENT DOCUMENTS 3,405,429 A * 10/1968 Vazquez ..... 24/563
4,193,174 A * 3/1980 Stephens ..... 24/543
4,835,824 A * 6/1989 Durham et al. ..... 24/346
5,083,741 A * 1/1992 Sancoff ..... 24/17 B
5,123,146 A * 6/1992 Olson ..... 24/30.5 P
5,159,730 A * 11/1992 Radvin ..... 24/543
6,101,684 A * 8/2000 Ginocchio ..... 24/543
6,105,218 A * 8/2000 Reekie ..... 24/543
6,378,175 B1 * 4/2002 Vanderpan ..... 24/545

* cited by examiner

*Primary Examiner*—Victor Sakran

(57) ABSTRACT

A cord clip for fastening a cord attached to e.g. an earphone to an object such as a clothes is disclosed. The cord clip includes a clipping portion for clamping the object and a cord holding portion for holding the cord. The clipping portion is formed by a first annular portion having a discontinuity at a part thereof. The clipping portion is capable of clamping the object at a clamping portion thereof provided by a narrow gap formed by the discontinuity of the first annular portion by means of an elastic resilient force of the first annular portion. The cord holding portion is formed by a second annular portion having a discontinuity at a part thereof. The cord holding portion is capable of holding the cord therein by means of an elastic resilient force of the second annular portion. This elastic resilient force of the second annular portion is independent of that of the first annular portion. The first annular portion and the second annular portion are formed integrally in a single member.

7 Claims, 2 Drawing Sheets

CORD CLIP

BACKGROUND OF THE INVENTION

1. Field of the Invention

The present invention relates to a cord clip for fastening a cord attached to e.g. an earphone to a clothes. More particularly, the invention relates to such cord clip having a clipping portion capable of clamping an object at a clamping portion thereof and a cord holding portion capable of holding the cord.

2. Description of the Related Art

A conventional cord clip will be described with reference to FIG. 3. As shown, a cord clip 10 includes an alligator clip 15 consisting essentially of a spring 11, a shaft 12 and a pair of clipping portions 13, 14 and a cord holding portion 16. The alligator clip 15 and the cord holding portion 16 are connected with each other, so that in use, the cord holding portion is used for securely holding the cord of an earphone or the like and the alligator clip is used for clamping a clothes, thereby to secure the cord to the clothes.

The above-described conventional cord clip 10 has many parts, so that it presents the problem of high part costs and high assembly costs for assembling these parts.

In order to decrease the number of parts, it is conceivable, for example, to cause the clipping portions of the alligator clip 15 to pinch the cord and the clothes together at one time so that the clipping portions may function also as the cord holding portion. However, such construction has proved unsatisfactory since when the alligator clip 15 is opened to be detached from the clothes, this may result in inadvertent simultaneous detachment of the cord. This is because the direction of the force effective for pinching the clothes coincides with the direction of the force used for holding the cord and also these forces affect each other.

The present invention has been made in view of the problems described above and its primary object is to provide improved cord clip comprising a clipping portion and a cord holding portion which portions are formed as one integral component and which portions provide respective effective forces independently of each other.

SUMMARY OF THE INVENTION

For accomplishing the above-noted object, according to the present invention, a cord clip comprises a clipping portion formed by a first annular portion having a discontinuity at a part thereof and a cord holding portion formed by a second annular portion having a discontinuity at a part thereof, said clipping portion being capable of clamping an object at a clamping portion thereof provided by a narrow gap formed by the discontinuity of the first annular portion by means of an elastic resilient force of the first annular portion, said cord holding portion being capable of holding a cord therein by means of an elastic resilient force of the second annular portion, said elastic resilient force of the second annular portion being independent of said elastic resilient force of the first annular portion, said first annular portion and said second annular portion are formed integrally in a single member.

With the cord clip having the above-described construction, as the first annular portion constituting the clipping portion having a clamping portion for clamping an object such as a clothes and the second annular portion constituting the cord holding portion for holding the cord are formed integrally in a single elastic member, the number of parts required may be reduced to the minimum (only one). As a result, the parts costs and the assembly costs may be reduced. Further, because the elastic resilient force applied to clamp the object, e.g. a clothes and the elastic resilient force applied to hod the cord are independent of each other, it is possible to avoid mutual interference between these forces. Hence, when the clamping of the clothes at the clipping portion is released, there will occur no inadvertent release of the cord at the cord holding portion.

According to a further preferred feature of the invention, an opening formed between opposed ends of the first annular portion at the discontinuity thereof has a greater aperture than the narrow gap at said clamping portion. With this, the object may be easily inserted through the opening into the clamping portion. More preferably, the aperture of said opening increases along a direction in opposition to an inserting direction of the object.

With the cord clip having the above-described construction, since the opening has an aperture greater than the gap of the clamping portion and this aperture increase along the direction in opposition to the inserting direction of the object such a clothes, the object or clothes can be inserted more easily into the clamping portion. More particularly, this insertion operation may be carried out by putting the object or clothes at the opening and then pressing the cord clip against the object or clothes for fixing the former to the latter.

According to a further preferred feature of the invention, in the cord clip described above, a direction of clamping the object by the clamping portion is substantially normal to a direction of holding the cord by the cord holding portion.

With the above feature, when the object is released by applying a force in the opposite direction to the clamping direction, such releasing force is substantially normal to the cord holding force. So that, the releasing force does not affect the cord holding force. Therefore, the problem of detachment of the cord during a releasing operation of the object may be avoided even more reliably.

According to a still further preferred feature of the invention, the first annular portion and the second annular portion are formed integrally of a resin, and the first annular portion and the second annular portion are annular in a common plane.

With the above, the cord clip of the invention may be manufactured easily and inexpensively by integral molding of an elastic resin by means of a standard resin molding technique. Further, in this resin molding process, if the annular portions are in a common plane, the mold used for resin molding may be simple in shape. Also, since the axes of the two annular portions extend parallel to each other, the finished product can be easily detached from the mold.

According to a still further preferred feature of the invention, the second annular portion is formed by a portion of an inner wall of the first annular portion and an extending portion extending inwardly from the inner wall of the first annular portion.

With the above, since the other portion of the second annular portion than the extending portion is formed by a portion of the inner wall of the first annular portion, the amount of the material needed for forming the cord clip may be reduced advantageously. Moreover, since the inner wall of the first annular portion extends along the cord held within the cord holding portion of the second annular portion, it is possible to maintain the orientation of the cord clip relative to the cord relatively stably.

According to a still further preferred feature of the invention, the clamping portion consists of a mating pair of a projection and a recess which can engage with each other.

With the above feature, the object such as a clothes may be firmly clamped at the mutually engaged projection and recess of the clamping portion.

Further and other objects and advantages of the invention will become apparent from the following description of the preferred embodiments of the invention with reference to the accompanying drawings.

DESCRIPTION OF PREFERRED EMBODIMENTS

Preferred embodiments of a cord clip relating to the present invention will be described below with reference to the accompanying drawings.

Figure 1:
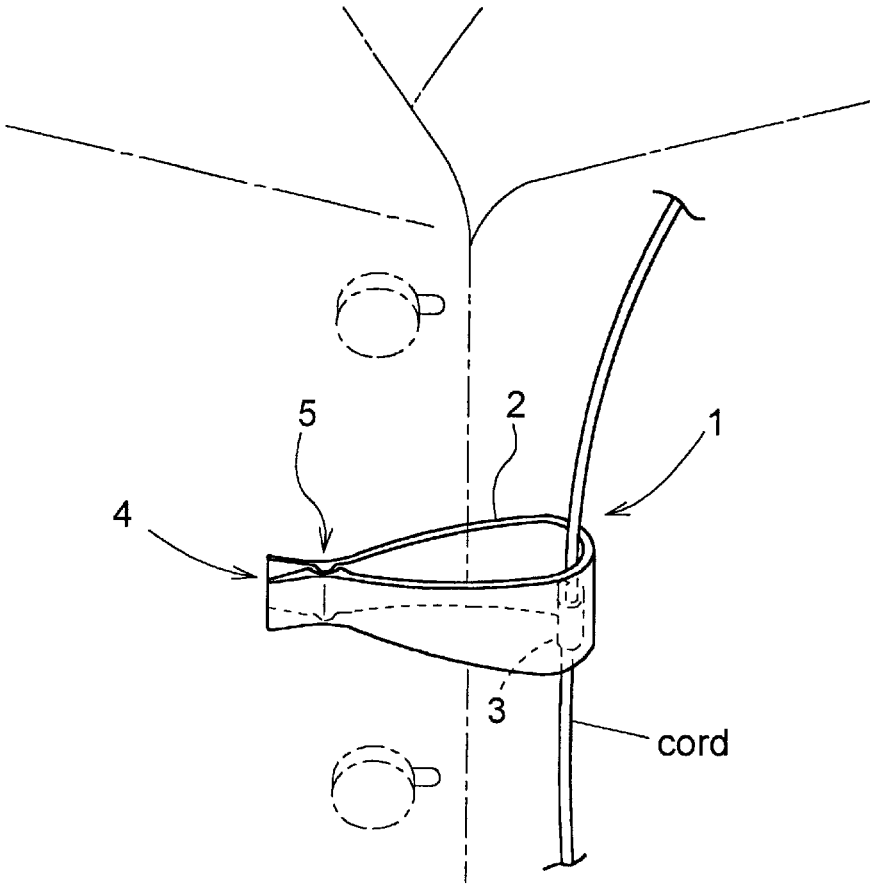
FIG. 1 is a view showing a cord clip according to one preferred embodiment of the present invention.
Figure 2:
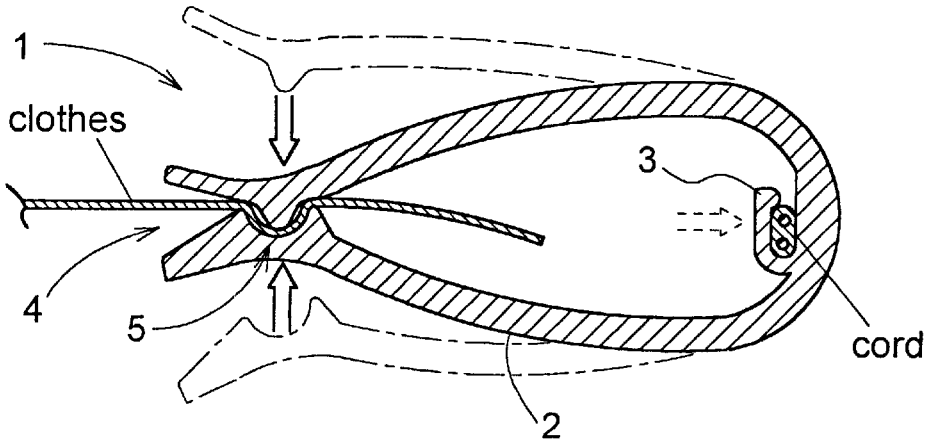
FIG. 2 is a plan view of the cord clip.
Figure 3:
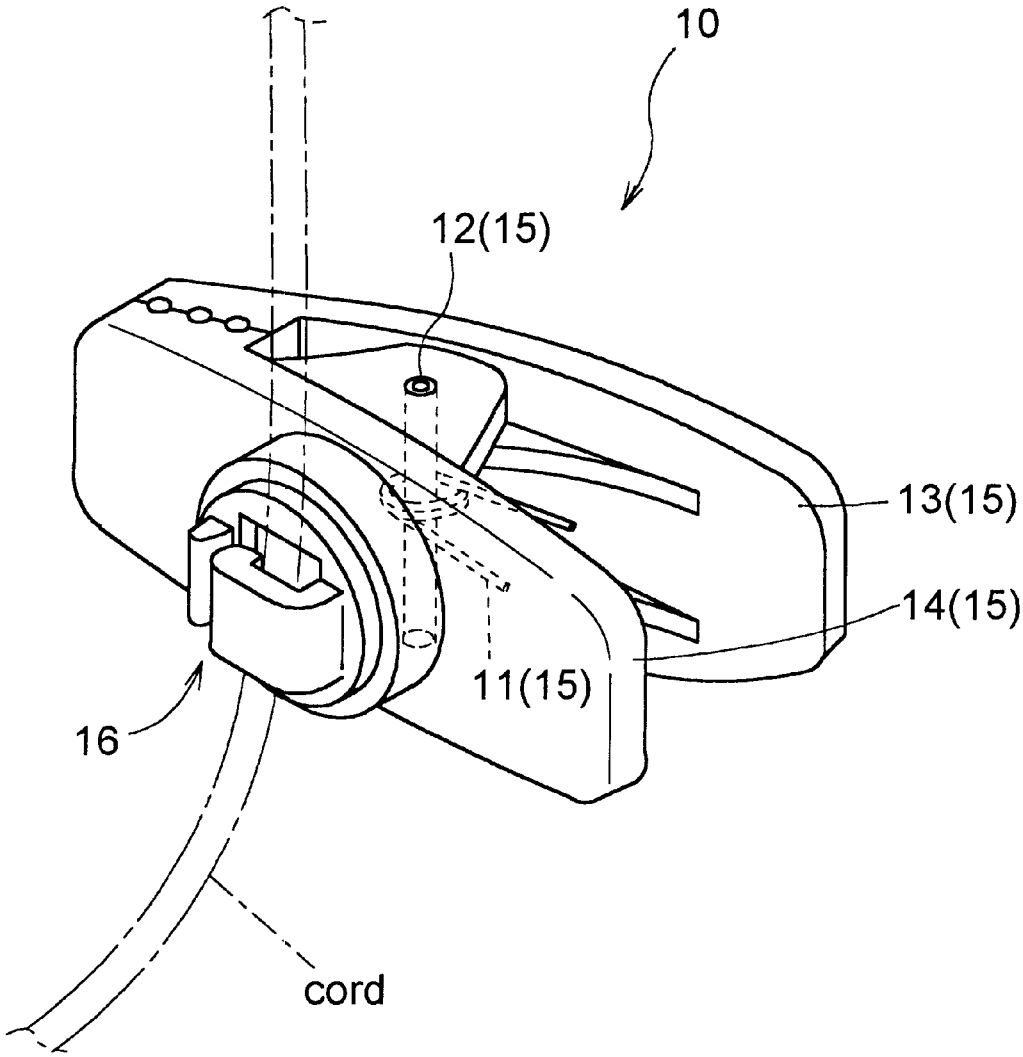
FIG. 3 is a view showing a cord clip according to the prior art.

A cord clip 1 shown in FIG. 1 and FIG. 2 includes a clipping portion 2 formed by a first annular portion which has a discontinuity at a part thereof and has elasticity and a cord holding portion 3 formed by a second annular potion which has a discontinuity at a part thereof and has elasticity. The clipping portion 2 is capable of clamping an object such as a clothes at a clamping portion 5 thereof provided by a narrow gap formed by the discontinuity of the first annular portion by means of an elastic resilient force from the first annular portion. On the other hand, the cord holding portion 3 is capable of holding a cord therein by means of an elastic resilient force from the second annular portion, which elastic resilient force is independent of the elastic resilient force of the first annular portion. Further, the clipping portion 2 formed by the first annular portion and the cord holding portion 3 formed by the second annular portion are formed integrally of a single member, that is, as one integral component.

More specifically, the cord clip 1 is manufactured by integral molding of the clipping portion 2 for clamping a clothes and the cord holding portion 3 for holding a cord by using elastic resin material. The clipping portion 2 includes a clamping portion 5 which consists, in this embodiment, of a mating pair of projection and recess which can engage with each other to firmly clamp the clothes therebetween against displacement of the clothes. At the discontinuity of the first annular portion forming the clipping portion 2, there is formed an opening 4 for allowing insertion of the clothes. This opening 4 has an aperture which is greater than the gap of the clipping portion 5 and which also increases along a direction in opposition to the inserting direction of the clothes. Accordingly, the clothes can be easily inserted through this opening 4 into the clipping portion 5 to be clipped thereat. The cord holding portion 3 is formed by providing an annular portion (i.e. the second annular portion) on the inner side of the clipping portion 2, so that the cord is held within this annular portion. The gap formed at the discontinuity of the second annular portion forming the cord holding portion 3 is appropriately dimensioned to reliably hold or clamp the cord against its significant displacement thereof while allowing slight degree of freedom in its sliding movement.

FIG. 2 is a plan view of the cord clip 1. As shown, the clothes is clamped at the clipping portion 2 and the cord is held at the cord holding portion 3, respectively. As the clipping portion 2 is made of the elastic material, its elastic resilience serves to clamp the clothes at the clamping portion 5. The direction of this elastic resilient force effective at the clamping portion 5 is denoted with solid-line arrows in FIG. 2. Whereas, the direction of the elastic resilient force effective at the cord holding portion 3 for holding the cord is denoted with a dot-line arrow in the figure. As apparent from this FIG. 2, these elastic resilient forces are two independent forces and in the directions normal to each other. Then, for releasing the cord clip 1 from the clothes, it is necessary to apply an external force in the direction against the direction of the elastic resilient force effective at the clamping portion 5 so as to widen the clamping portion 5. In such case too, since the direction of this external force is substantially normal to the direction of the elastic resilient force effective at the cord holding portion 3, the external force applied for widening the clamping portion 5 does not result in widening the gap at the cord holding portion 3. That is, the cord will remain held within the cord holding portion 3 reliably.

Further, with this cord clip 1, since the annular portions respectively forming the clipping portion 2 and the cord holding portion 3 are annular in shape in a common plane, the mold used for the resin molding of the cord clip 1 can be simple in shape and construction and also detachment of the finished product from the mold can be easily carried out.

Moreover, since the cord holding portion 3 is formed by a portion of the inner wall of the clipping portion 2 and an extending portion extending from this inner wall inwardly of the clipping portion 2, the material needed for molding the cord clip 1 can be reduced advantageously. In addition, since the inner wall of the clipping portion 2 extends along the length of the cord held within the cord holding portion, it is possible to maintain the orientation of the cord clip 1 relative to the cord relatively stably.

The invention's cord clip is not limited to the one described and shown in the foregoing embodiment.

For instance, the shape of the cord clip is not limited to the oval shape shown. It may be any shape such as triangular, rectangular, polygonal, etc. as long as such modified shape too allows the clipping portion and the cord holding portion to provide independent forces. Also, the material forming this cord clip is not limited to resin material. It can be any material having elasticity. And, more preferably, such material should be easily molded or formed into a desired shape.

The present invention may be embodied in any other manner than described above. The disclosed embodiments are not limiting, but only illustrating the present invention. Further and other modifications will be readily made by one skilled in the art without departing from the essential spirit of the invention defined in the appended claims.

What is claimed is:

1. A cord clip comprising:

a clipping portion formed by a first annular portion having a discontinuity at a part thereof, said clipping portion being capable of clamping an object at a clamping portion thereof provided by a narrow gap formed by the discontinuity of the first annular portion by means of an elastic resilient force of the first annular portion; and a cord holding portion provided inside said first annular portion and formed by a second annular portion having a discontinuity at a part thereof, said cord holding portion being capable of holding a cord therein by means of an elastic resilient force of the second annular portion, said elastic resilient force of the second annular portion being independent of said elastic resilient force of the first annular portion, wherein said first annular portion and said second annular portion being formed integrally, and a direction of clamping the object by the clamping portion being substantially perpendicular to a direction of holding the cord by the cord holding portion.

2. The cord clip according to claim 1, wherein an opening formed between opposed ends of the first annular portion at the discontinuity thereof has a greater aperture than the narrow gap at said clamping portion so as to facilitate insertion of the object through the opening into the clamping portion.

3. The cord clip according to claim 2, wherein the aperture of said opening increases along a direction in opposition to an inserting direction of the object.

4. The cord clip according to claim 1, wherein the first annular portion and the second annular portion are formed integrally of a resin.

5. The cord clip according to claim 4, wherein the first annular portion and the second annular portion are annular in a common plane.

6. The cord clip according to claim 1, wherein the second annular portion is formed by a portion of an inner wall of the first annular portion and an extending portion extending inwardly from the inner wall of the first annular portion.

7. The cord clip according to claim 1, wherein the clamping portion consists of a mating pair of a projection and a recess which selectively engage with each other.

* * * * *